US005493971A

United States Patent [19]

Lewis et al.

[11] Patent Number: 5,493,971

[45] Date of Patent: Feb. 27, 1996

[54] LASER-IMAGEABLE PRINTING MEMBERS AND METHODS FOR WET LITHOGRAPHIC PRINTING

[75] Inventors: Thomas E. Lewis, E. Hampstead; Kenneth R. Cassidy, Goffstown, both of N.H.

[73] Assignee: Presstek, Inc., Hudson, N.H.

[21] Appl. No.: 227,002

[22] Filed: Apr. 13, 1994

[51] Int. Cl.[6] ..... B41N 1/08

[52] U.S. Cl. ..... 101/454; 101/457; 101/459; 101/467

[58] Field of Search ..... 101/453, 454, 101/455, 456, 457, 459, 467, 401.1; 430/302, 945

[56] References Cited

U.S. PATENT DOCUMENTS

| | | | |
|---|---|---|---|
| 3,181,461 | 5/1965 | Fromson | 101/456 |
| 3,637,379 | 1/1972 | Hallman et al. | 430/323 |
| 3,637,380 | 1/1972 | Hallman et al. | 430/323 |
| 3,637,381 | 1/1972 | Hallman et al. | 430/297 |
| 3,637,383 | 1/1972 | Hallman et al. | 430/322 |
| 3,650,743 | 3/1972 | Hallman et al. | 430/322 |
| 3,707,372 | 12/1972 | Hallman et al. | 430/296 |
| 3,733,200 | 5/1973 | Takaishi et al. | 101/457 |
| 3,902,976 | 9/1975 | Walls | 205/127 |
| 3,971,660 | 7/1976 | Stachle | 430/18 |
| 4,020,762 | 5/1977 | Peterson | 101/467 |
| 4,037,075 | 7/1977 | Pugsley et al. | 219/121.85 |
| 4,054,094 | 10/1977 | Caddell et al. | 101/467 |
| 4,063,949 | 12/1977 | Uhlig et al. | 101/467 |
| 4,087,341 | 5/1978 | Takahashi et al. | 204/129.43 |
| 4,214,249 | 7/1980 | Kasai et al. | 346/76 I |
| 4,232,105 | 11/1980 | Shinohara et al. | 101/456 |
| 4,292,396 | 9/1981 | Eime et al. | 101/456 |
| 4,384,011 | 5/1983 | Aoyama et al. | 430/306 |
| 4,427,765 | 1/1984 | Mohr et al. | 430/525 |
| 4,596,760 | 6/1986 | Ballarini et al. | 430/278 |
| 4,731,317 | 3/1988 | Fromson et al. | 430/159 |
| 4,842,988 | 6/1989 | Herrmann et al. | 430/14 |
| 4,842,990 | 6/1989 | Herrmann et al. | 430/272 |
| 4,861,698 | 8/1989 | Hiruma et al. | 101/457 |
| 4,911,075 | 3/1990 | Lewis et al. | 101/453 |
| 4,947,750 | 8/1990 | Lewis et al. | 101/459 |
| 4,958,563 | 9/1990 | Lewis et al. | 101/458 |
| 5,053,311 | 10/1991 | Makino et al. | 430/166 |
| 5,147,490 | 9/1992 | Leenders et al. | 156/238 |
| 5,258,263 | 11/1993 | Cheema et al. | 101/467 |
| 5,259,311 | 11/1993 | McCaughey, Jr. | 101/401.1 |
| 5,366,844 | 11/1994 | Verburgh et al. | 430/258 |

FOREIGN PATENT DOCUMENTS

| | | |
|---|---|---|
| 0573092 | 12/1993 | European Pat. Off. . |
| 0573091 | 12/1993 | European Pat. Off. . |
| 3-197191 | 8/1991 | Japan . |
| 3-197190 | 8/1991 | Japan . |

OTHER PUBLICATIONS

"Lasers in Platemaking", Graphic Arts Monthly, Dec. 1975, pp. 70–74. Albert R. Materazzi.

Nechiporenko et al., "Direct Method of Producing Waterless Offset Plates By Controlled Laser Beam". Research Disclosure, Apr. 1980, at p. 131.

*Primary Examiner*—Stephen Funk

*Attorney, Agent, or Firm*—Cesari and McKenna

[57] ABSTRACT

Lithographic printing constructions and methods of imaging them. The constructions include a grained-metal substrate, a protective layer that can also serve as an adhesion-promoting primer, and an ablatable oleophilic surface layer. In operation, imagewise pulses from an imaging laser interact with the surface layer, causing ablation thereof and, probably, inflicting some damage to the underlying protective layer as well. The imaged plate may then be subjected to a solvent that eliminates the exposed protective layer, but which does no damage either to the surface layer or to the unexposed protective layer lying thereunder.

31 Claims, 1 Drawing Sheet

LASER-IMAGEABLE PRINTING MEMBERS AND METHODS FOR WET LITHOGRAPHIC PRINTING

BACKGROUND OF THE INVENTION

1. Field of the Invention

The present invention relates to digital printing apparatus and methods, and more particularly to so-called "wet" lithographic printing plate constructions that may be imaged on- or off-press using digitally controlled laser output.

2. Description of the Related Art

Traditional techniques of introducing a printed image onto a recording material include letterpress, flexographic and gravure printing and offset lithography. All of these printing methods require a printing member, usually loaded onto or integral with a plate cylinder of a rotary press for efficiency, to transfer ink in the pattern of the image. In letterpress and flexographic printing, the image pattern is represented on the printing member in the form of raised areas that accept ink and transfer it onto the recording medium by impression; flexographic systems, which utilize elastomeric surfaces, have received more widespread acceptance due to the broad variety of compatible substrates and the ability to run with fluid inks. Gravure printing cylinders, in contrast to raised-surface systems, contain series of wells or indentations that accept ink for deposit onto the recording medium; excess ink must be removed from the cylinder by a doctor blade or similar device prior to contact between the cylinder and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording material; the plate first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to or in conjunction with inking. The ink-repellent fountain solution prevents ink from adhering to the non-image areas, but does not affect the oleophilic character of the image areas.

If a press is to print in more than one color, a separate printing plate corresponding to each color is required, each such plate usually being made photographically as described below. In addition to preparing the appropriate plates for the different colors, the operator must mount the plates properly on the plate cylinders of the press, and coordinate the positions of the cylinders so that the color components printed by the different cylinders will be in register on the printed copies. Each set of cylinders associated with a particular color on a press is usually referred to as a printing station.

In most conventional presses, the printing stations are arranged in a straight or "in-line" configuration. Each such station typically includes an impression cylinder, a blanket cylinder, a plate cylinder and the necessary ink (and, in wet systems, dampening) assemblies. The recording material is transferred among the print stations sequentially, each station applying a different ink color to the material to produce a composite multi-color image. Another configuration, described in U.S. Pat. No. 4,936,211, relies on a central impression cylinder that carries a sheet of recording material past each print station, eliminating the need for mechanical transfer of the medium to each print station.

With either type of press, the recording medium can be supplied to the print stations in the form of cut sheets or a continuous "web" of material. The number of print stations on a press depends on the type of document to be printed. For mass copying of text or simple monochrome line-art, a single print station may suffice. To achieve full tonal rendition of more complex monochrome images, it is customary to employ a "duotone" approach, in which two stations apply different densities of the same color or shade. Full-color presses apply ink according to a selected color model, the most common being based on cyan, magenta, yellow and black (the "CMYK" model). Accordingly, the CMYK model requires a minimum of four print stations; more may be required if a particular color is to be emphasized. The press may contain another station to apply spot lacquer to various portions of the printed document, and may also feature one or more "perfecting" assemblies that invert the recording medium to obtain two-sided printing.

The plates for an offset press are usually produced photographically. To prepare a wet plate using a typical negative-working subtractive process, the original document is photographed to produce a photographic negative. This negative is placed on an aluminum plate having a water-receptive, anodized (textured) surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), exposing the hydrophilic surface of the aluminum plate. Conventional wet plates also typically contain primer layers, which provide better anchorage of the photopolymer to the aluminum substrate.

A similar photographic process is used to create dry plates, which typically include an oleophobic (e.g., silicone) surface layer coated onto a photosensitive layer, which is itself coated onto a substrate of suitable stability (e.g., a primed aluminum sheet). Upon exposure to actinic radiation, the photosensitive layer cures to a state that destroys its bonding to the surface layer. After exposure, a treatment is applied to deactivate the photoresponse of the photosensitive layer in unexposed areas and to further improve anchorage of the surface layer to these areas. Immersion of the exposed plate in developer results in dissolution and removal of the surface layer at those portions of the plate surface that have received radiation, thereby exposing the ink-receptive, cured photosensitive layer.

Although dry printing requires fewer mechanical assemblies and reduced expenditure of consumables, most high-volume offset printing is currently done on wet-running presses. A typical wet printing plate, as noted above, is based on a water-receptive aluminum surface coated with a hard-enable oleophilic photopolymer. While such plates have been criticized as causing premature wear on inking and transfer rollers (see., e.g., U.S. Pat. No. 4,054,094 at col. 1, lines 57–63), they nonetheless remain the standard for most of the long-run printing industry due to their durability and ease of manufacture. Indeed, the form and ink rollers ordinarily do not even contact the plate directly, instead making contact with a layer of fountain solution adsorbed on the surface of the plate; that contact layer provides a substantial lubricating effect that counteracts any tendency toward wear.

Rendering a layer of aluminum, which is hydrophilic but fragile in an unstructured or polished state, sufficiently durable to repeatedly accept fountain solution in a printing environment requires special treatment. Any number of chemical or electrical techniques, in some cases assisted by the use of fine abrasives to further roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341.

A structured or grained surface can also be produced by controlled oxidation, a process commonly called "anodizing." The anodized aluminum plate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape — including, most importantly, water molecules. The treated surface also promotes adhesion to an overlying photopolymer layer. Anodizing and silicate treatment processes are described in U.S. Pat. Nos. 3,181,461 and 3,902,976.

Textured chromium surfaces also exhibit substantial hydrophilic character, and can be used in lieu of aluminum in wet-running lithographic plates. Such surfaces can be produced by, for example, electrodeposition, as described in U.S. Pat. No. 4,596,760. As used herein, the term "textured" refers to any modification to the surface topography of a metal plate that results in enhancement of hydrophilic character.

Although chromium and stabilized aluminum grain surfaces exhibit good durability characteristics during printing, their hydrophilic character also renders them hygroscopic. Excessive sorption of moisture facilitates ongoing chemical reaction that may result in reduction or elimination of hydrophilic character. For this reason, if plates having such surfaces are to be stored, they typically first receive a coating of a protective, water-soluble polymer in a process known as "gumming." On the other hand, as discussed below, the ease with which hydrophilicity is lost provides a basis for digitally controlled, point-by-point imaging of metal-based lithographic plates.

The desire for electronic alternatives to traditional photographic platemaking processes stems from the time, expense, equipment requirements and environmental compliance measures associated with the latter. Recently developed computer-controlled imaging systems, some of which can be utilized on-press, alter the ink-receptivity of blank plates in a pattern representative of the image to be printed. Such imaging devices include sources of electromagnetic-radiation pulses, produced by one or more laser or non-laser sources, that create chemical changes on plate blanks (thereby eliminating the need for a photographic negative); ink-jet equipment that directly deposits ink-repellent or ink-accepting spots on plate blanks; and spark-discharge equipment, in which an electrode in contact with or spaced close to a plate blank produces electrical sparks to physically alter the topology of the plate blank, thereby producing "dots" which collectively form a desired image (see., e.g., U.S. Pat. No. 4,911,075).

For example, as described in U.S. Pat. Nos. 4,947,750 and 4,958,563, intensively heating a grained aluminum or chromium surface transforms that surface from a hydrophilic to a hydrophobic, oleophilic state. Therefore, by selectively exposing a printing plate bearing such a surface to heat, it is possible to create on the plate surface a pattern of ink-receptive image points corresponding to a desired image. Because unexposed surface regions remain hydrophilic, the result is a fully imaged lithographic plate that may immediately be used for printing without the need for chemical processing. Suitable point sources of heat for such plates include spark-discharge and laser equipment.

Indeed, because of the ready availability of laser equipment and their amenability to digital control, significant effort has been devoted to the development of laser-based imaging systems. Early examples utilized lasers to etch away material from a plate blank to form an intaglio or letterpress pattern. See, e.g., U.S. Pat. Nos. 3,506,779; 4,347,785. This approach was later extended to production of lithographic plates, e.g., by removal of a hydrophilic surface to reveal an oleophilic underlayer. See, e.g., U.S. Pat. No. 4,054,094. These systems generally require high-power lasers, which are expensive and slow.

Other laser-based systems for imaging hydrophilic plates operate by removal of inorganic chalcogenide (see, e.g., U.S. Pat. No. 4,214,249) or organic polymer (see, e.g., U.S. Pat. Nos. 5,339,737 and 5,353,705 layers, which are hydrophilic, from an oleophilic substrate such as polyester. Again, while use of a removable hydrophilic surface coating was characterized in the '094 patent as superior to the traditional construction based on a hydrophilic substrate, it nonetheless remains outside the mainstream of conventional printing.

Given the ease with which the hydrophilic structure of a grained-metal plate is disrupted, laser-based imaging systems that operate by etching or ablation ordinarily can be utilized with such plates only by selective destruction of hydrophilic character. This is the case in the '750 patent mentioned above, where the metal is transformed directly, and also in the '094 patent and in U.S. Pat. No. 4,063,949, where the laser is used to melt or slag an overlying polymer into the grained surface, filling the topography and thereby transforming it into an oleophilic surface. Laser ablation of an overlying oleophilic polymer layer to reveal a grained, hydrophilic metal layer thereunder — resulting in a plate equivalent to the conventional photopolymer-based construction — has not, as far as we are aware, heretofore been possible. Either the polymer would partially melt, clogging the metal surface grain and rendering it hydrophobic as described in the '094 patent, or, if the laser were operated at power levels sufficient to ensure complete polymer ablation, its energy would physically transform the surface and render it hydrophobic in the manner of the '750 patent.

DESCRIPTION OF THE INVENTION

A. Brief Summary of the Invention

The present invention extends the benefits of ablative laser imaging technology to traditional grained-metal plates. As used herein, the term "plate" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

In accordance with the invention, a lithographic printing construction includes a grained-metal substrate, a protective layer that can also serve as an adhesion-promoting primer, and an ablatable oleophilic surface layer. In operation, imagewise pulses from an imaging laser interact with the surface layer, causing ablation thereof and, probably, inflicting some damage to the underlying protective layer as well. The imaged plate may then be subjected to a solvent that eliminates the exposed protective layer, but which does no damage either to the surface layer or the unexposed protective layer lying thereunder. By using the laser to directly reveal only the protective layer and not the hydrophilic metal layer, the surface structure of the latter is fully preserved; the action of the solvent does no damage to this structure.

While lasers have previously been used to expose a photosensitive blank for traditional chemical processing (see, e.g., U.S. Pat. Nos. 3,506,779; 4,020,762), the present invention can be utilized with a single environmentally harmless and conveniently applied solvent, such as water. At the same time, the invention offers the advantage of a metal hydrophilic substrate consistent with current printing practice, unlike other laser-based approaches that utilize hydrophilic layers that reside at the top of the plate construction, and which are inorganic or polymeric in nature.

On the other hand, using such a polymer-based hydrophilic material as the sandwiched protective layer can enhance the convenience associated with the invention still further by eliminating the need to dissolve and remove the exposed protective layer. After it is imaged, such a construction can be used immediately to print, since all imaged regions — i.e., the exposed protective layer — will be hydrophilic. In the course of a long printing run, should this layer begin to disintegrate under the stress of repeated dampenings, it will simply solubilize into the bulk fountain solution, revealing the hydrophilic metal layer underneath. At no time will the printing characteristics of the plate be affected, since one hydrophilic layer is merely exchanged for another.

The plates of the present invention are positive-working, in the parlance associated with conventional photoexposed plates, since the portions removed by ablation are not the "image" regions that accept ink, but are instead the "background" area that adsorbs fountain solution in order to reject ink. Such plates are also called "indirect-write" plates.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

1. Imaging Apparatus

Figure 1:
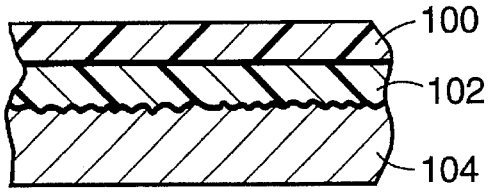
FIG. 1 is an enlarged sectional view of a lithographic plate having an absorptive, ablatable top layer, a protective layer, and a grained metal substrate.

Imaging apparatus suitable for use in conjunction with the present printing members includes at least one laser device that emits in the region of maximum plate responsiveness, i.e., whose $lambda_{max}$ closely approximates the wavelength region where the plate absorbs most strongly. Specifications for lasers that emit in the near-IR region are fully described in the '737 patent (the entire disclosure of which is hereby incorporated by reference); lasers emitting in other regions of the electromagnetic spectrum are well-known to those skilled in the art.

Suitable imaging configurations are also set forth in detail in the '737 patent. Briefly, laser output can be provided directly to the plate surface via lenses or other beam-guiding components, or transmitted to the surface of a blank printing plate from a remotely sited laser using a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e, the number of image points per unit length). Off-press applications, which can be designed to accommodate very rapid plate movement (e.g., through use of high-speed motors) and thereby utilize high laser pulse rates, can frequently utilize a single laser as an imaging source.

2. Lithographic Printing Plates

Refer first to FIG. 1, which illustrates a representative embodiment of a lithographic plate in accordance with the present invention. The plate illustrated in FIG. 1 includes a radiation-absorptive surface layer 100, a protective layer 102, and a hydrophilic metal substrate 104. These layers will now be described in detail.

a. Surface Layer 100

The primary characteristics of layer 100 are vulnerability to ablation using commercially practicable laser imaging equipment (such as the near-IR devices described in the '737 patent), and sufficient ink-accepting and hydrophobic character to function as an image or ink-carrying portion of a lithographic printing plate. Layer 100 should also, upon ablation, produce environmentally and toxicologically innocuous byproducts, and exhibit substantial durability to withstand the rigors of printing. The latter characteristics depends, in part, on application weight.

Vulnerability to ablation ordinarily stems from the ability to absorb strongly in the wavelength region in which the imaging laser emits. Absorption can be enhanced by use of a polymeric system that intrinsically absorbs in the wavelength region of interest, or by use of a polymeric coating into which absorptive components have been dispersed or dissolved.

Nitrocellulose-based materials can be made to absorb strongly in the near-IR region through incorporation of selectively absorptive compounds as described in the '737 patent, and are therefore useful in conjunction with the imaging systems described in that application. Suitable nitrocellulose coatings can include thermoset-cure capability, and may be produced as follows:

| Component | Parts |
|---|---|
| Nitrocellulose | 14 |
| Cymel 303 | 4 |
| 2-Butanone (methyl ethyl ketone) | 236 |

The nitrocellulose utilized is the 30% isopropanol wet 5–6 Sec RS Nitrocellulose supplied by Aqualon Co., Wilmington, Del. Cymel 303 is hexamethoxymethylmelamine, supplied by American Cyanamid Corp.

An IR-absorbing compound is added to this base composition and dispersed therein. Use of the following seven compounds in the proportions that follow results in production of useful absorbing layers.

EXAMPLES 1–7

| Example<br>Component | 1 | 2 | 3 | 4<br>Parts | 5 | 6 | 7 |
|---|---|---|---|---|---|---|---|
| Base Composition | 252 | 252 | 252 | 252 | 252 | 252 | 252 |
| NaCure 2530 | 4 | 4 | 4 | 4 | 4 | 4 | 4 |
| Vulcan XC-72 | 4 | — | — | — | — | — | — |
| Polypyrrole | — | 5 | — | — | — | — | — |
| Octabutoxy-phthalocyanine | — | — | 4 | — | — | — | — |
| 2,3-naphthalocyanine | — | — | — | 4 | — | — | — |
| Nigrosine Base NG-1 | — | — | — | — | 8 | — | — |
| IR-810 | — | — | — | — | — | 2 | — |
| Projet 900NP | — | — | — | — | — | — | 3 |

NaCure 2530, supplied by King Industries, Norwalk, Conn., is an amine-blocked p-toluenesulfonic acid solution in an isopropanol/methanol blend. Vulcan XC-72 is a conductive carbon black pigment supplied by the Special Blacks Division of Cabot Corp., Waltham, Mass. Polypyrrole may be obtained from Polymer Technics, Inc., Melbourne, Fla. 1,4,8,11,15,18,22,25-octabutoxy-29H,31H-phthalocyanine and 2,3-naphthalocyanine are available from Aldrich Chemical Co. Milwaukee, Wis. Nigrosine Base NG-1 is supplied as a powder by N H Laboratories, Inc., Harrisburg, Penn. 2,3,4,6-tetrahydro-1,2-dimethyl-6-((1-oxo-2,3-bis(2,4,6-trimethylphenyl)-7(1H) -indolizinylidene)-ethylidene)-quinolinium trifluoromethanesulfonate is sold under the trade designation IR-810 by Eastman Fine Chemicals, Rochester, N.Y. Project 900 NP is a proprietary IR absorber marketed by ICI Colours & Fine Chemicals, Manchester, United Kingdom.

Following addition of the IR absorber and dispersion thereof in the base composition, the blocked PTSA catalyst is added to form the finished composition.

Alternatively, organic or metal-chelate chromophores can be used in lieu of pigments. Such materials are desirably soluble or easily dispersed in the material which, when cured, functions as layer 100. IR-absorptive dyes include a variety of phthalocyanine and naphthalocyanine compounds; and cyanine compounds as described, for example, in U.S. Pat. Nos. 4,446,223, 5,108,873, 5,035,977, 5,034,303, 5,019,480, 4,973,572, 4,950,639, 4,950,640, 4,948,776, 4,948,777, and 4,948,778. IR-absorptive metal-chelate compounds are described, for example, in U.S. Pat. Nos. 4,892,584 (especially preferred for aqueous compositions due to solubility of the disclosed compounds in water), 4,912,083, 5,036,040, 5,024,923, 4,913,846, 4,791,023, 4,921,317, 4,767,571, 4,675,357. Also useful are the substituted indophenol compounds described in U.S. Pat. No. 4,923,638.

Chromophores that absorb in the ultraviolet region include benzoin, pyrene, benzophenones and benzotriazoles. Chromophores that absorb in all regions of the visible spectrum can also be readily obtained. See, e.g., Brackman, *Lambdachrome Laser Dyes* (1986), published by Lambda Physik GmbH, D-3400, Göttingen, Germany. Indeed, suitable chromophores can be found to accommodate imaging using virtually any practicable type of laser. The chromophores concentrate laser energy within the absorbing layer and cause its destruction, disrupting and possibly consuming, in part, the underlying protective layer as well.

Polymeric systems other than nitrocellulose can readily be used to form surface layer 100. The following two examples are representative of such alternative systems.

EXAMPLES 8–9

| Example<br>Component | 8 | 9 |
|---|---|---|
| | Parts | |
| Ucar Vinyl VMCH | 10 | — |
| Saran F-310 | — | 10 |
| Cymel 303 | 4 | — |
| Nacure 2530 | 4 | — |
| Vulcan XC-72 | 4 | — |
| Nigrosine Base NG-1 | — | 4 |
| 2-Butanone | 190 | 190 |

Ucar Vinyl VMCH is a hydroxy-functional vinyl terpolymer supplied by Union Carbide Chemicals & Plastics Co., Danbury, Conn. Saran F-310 is a vinylidenedichloride-acrylonitrile copolymer supplied by Dow Chemical Co., Midland, Mich.

b. Protective Layer 102

Layer 102 must protect substrate 104 against both thermal degradation from laser radiation (which, as discussed in the '750 patent, can transform the hydrophilic surface into one that repels water) and environmental degradation that can result from storage. Thus, layer 102 should adhere well to substrate 104 and absorb, in application thicknesses, laser radiation that would otherwise reach substrate 104. Layer 102 should also, of course, adhere well to surface layer 100; its function is therefore analogous, in terms of adhesion, to primer layers that serve to anchor one plate layer to another.

In general, polymeric materials satisfying these criteria include those having regions with exposed polar moieties such as hydroxyl or carboxyl groups, examples being various cellulosics modified to incorporate such groups, proteinaceous materials such as gelatin or casein, and polyvinyl alcohols.

Following ablation, exposed regions of layer 102 either disappear under the action of a solvent, revealing the underlying hydrophilic layer, or contribute to the imaging process through innate hydrophilic behavior. In the former case, the solvent should be environmentally safe for ease of disposal — water is ideal — and should also exhibit only a limited compatibility with layer 102, as discussed in greater detail below.

Useful water-soluble hydrophilic layers, which may be removed by subjection of the imaged plate to water or left on the plate to either adsorb fountain solution or degrade to expose the hydrophilic substrate 104, include the products obtained in accordance with U.S. Pat. No. 4,427,765 by reacting a water-soluble organic polymer having acid functional groups containing phosphorus or sulfur with a salt of an at least divalent metal cation. Useful examples disclosed in the '765 patent (the entire disclosure of which is hereby incorporated by reference) include polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde. Also useful are the water-soluble polymers discussed in U.S. Pat. No. 4,063,949 (the entire disclosure of which is hereby incorporated by reference), including (in addition to polyvinyl alcohol) polyvinyl pyrrolidone, cellulose ethers such as carboxymethylcellulose, hydroxymethylcellulose or hydroxyethylcellulose, caseins, and gelatins.

Useful water-insoluble hydrophilic coatings, which can generally withstand the repeated application of fountain solution and therefore do not degrade substantially during printing, include the crosslinked, polymeric reaction products of polyvinyl alcohol and hydrolyzed tetraethylorthosilicate described in U.S. Pat. No. 3,971,660, the entire disclosure of which is hereby incorporated by reference.

c. Hydrophilic Metal Substrate 104

Preferred hydrophilic metal substrates include those based on aluminum or chromium that have undergone a texturing process such as anodyzing or electrodeposition. These materials are readily available, inexpensive, and familiar to practitioners. However, it is also possible, although less economically desirable, to use other metals such as copper or steel that have been rendered hydrophilic through texturing. Typically, the thickness of substrate 104 is determined by the need for durability during printing. Excessive thicknesses merely add unnecessary cost and can be more difficult to work with during plate manufacture.

Suitable substrates include the hydrophilic aluminum materials described in the '461, '976 and '341 patents noted above, and the hydrophilic electrodeposited chromium surface described in the above-mentioned '760 patent. The entire disclosures of all four of these references are hereby incorporated by reference. Preferred thicknesses for substrate 104 range from 0.004 to 0.02 inch, with thicknesses in the range 0.005–0.012 inch being particularly preferred.

3. Imaging Techniques

In operation, the plates of the present invention are selectively exposed, in a pattern representing an image, to the output of an imaging laser, which is scanned over the plate. Laser output removes at least surface layer 100, thereby directly producing on the plate an array of image features or potential image features.

Figure 2:
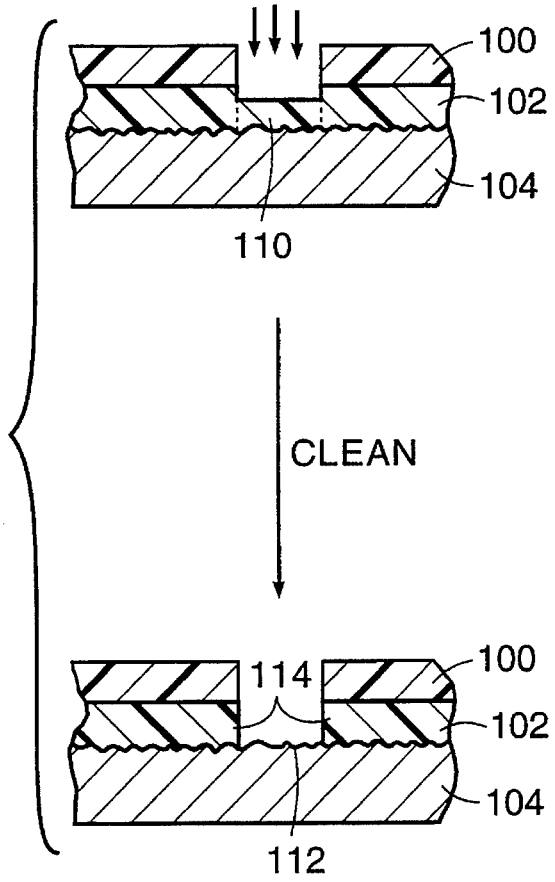
FIG. 2 shows the mechanism by which such a plate may be imaged by a laser source.

Refer now to FIG. 2, which illustrates the imaging process of the present invention in greater detail. Imaging radiation fully removes surface layer 100 and at least some of protective layer 102, leaving a residual plug 110 of the protective-layer material. However, the imaging pulse does not reach, and therefore does no damage to substrate 104.

In one embodiment, the laser-imaged plate is subjected to the action of a cleaning solvent that removes plug 110, thereby exposing a surface 112 of substrate 104. It is important, however, to avoid the use of cleaners having excessive solvency power with respect to protective layer 102, since it is important to retain the integrity of the boundary walls 114 that define an image feature. Too much solvent action can erode walls 114, eliminating the underlying support provided by layer 102 around the periphery of the image feature and degrading image sharpness or reducing plate life.

For example, water-sensitive materials suitable for use as layer 102 (e.g., polyvinyl alcohol) frequently exhibit less vulnerability to water that has combined with one or more co-solvents such as an alcohol (e.g., ethylene or propylene glycol, or benzyl alcohol) or a glycol ether; with undercutting thereby retarded, such mixtures can be used to clean plug 110 without material damage to walls 114. Similarly, alkaline-soluble materials such as caseins or gelatins can be cleaned with an aqueous solution pH-buffered at acid or neutral pH to avoid damage to walls 114. Indeed, typical fountain solutions are buffered at pH 4.5 and tend to include co-solvents, and so can be used with advantage to clean the imaged plate.

In a second embodiment, layer 102 is itself hydrophilic, obviating the need for a cleaning step. In this embodiment the plate is used for wet printing immediately following laser exposure, and residual plug 110 of layer 102 gradually dissolves away in use. Such dissolution does not interfere with the integrity of the printing process. Material from plug 110 is carried by the conveying form rollers back to the bulk source of fountain solution and is also lost with the fountain solution onto the substrate being printed; at the same time, its removal from the plate merely exposes the underlying hydrophilic surface 112. At no point is hydrophilic action lost or compromised.

It will therefore be seen that we have developed advantageous printing plate constructions and imaging techniques for use therewith. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A lithographic printing member directly imageable by laser discharge, the member comprising:

a. an ink-accepting first layer characterized by ablative absorption of imaging radiation;

b. a second layer underlying the first layer, the second layer not being characterized by ablative absorption of imaging radiation and being compatible with but not excessively soluble in a cleaning solvent; and c. a hydrophilic metal substrate, d. the first layer and the substrate not being soluble in the cleaning solvent.

2. The member of claim 1 wherein the second layer is characterized by solubility in water.

3. The member of claim 1 wherein the second layer is characterized by compatibility with but not excessive solubility in water combined with a co-solvent.

4. The member of claim 1 wherein the second layer is characterized by compatibility with but not excessive solubility in water combined with a co-solvent selected from the group consisting of alcohols and glycol ethers.

5. The member of claim 1 wherein the second layer is characterized by compatibility with but not excessive solubility in water pH-buffered to acid or neutral pH.

6. The member of claim 1 wherein the second layer is a primer that anchors the first layer to the substrate.

7. The member of claim 1 wherein the substrate is aluminum having a textured surface topography.

8. The member of 1 wherein the substrate is chromium having a textured surface topography.

9. The member of claim 1 wherein the first layer comprises a substance that absorbs near-IR radiation.

10. The member of claim 1 wherein the first layer comprises a substance that absorbs ultraviolet radiation.

11. The member of claim 1 wherein the first layer comprises a substance that absorbs visible radiation.

12. The member of claim 1 wherein the second layer is present in sufficient thickness to prevent damage to the substrate from exposure to imaging laser radiation.

13. A lithographic printing member directly imageable by laser discharge, the member comprising:

a. an ink-accepting first layer characterized by ablative absorption of imaging radiation;

b. a second layer underlying the first layer, the second layer being hydrophilic and compatible with but not excessively soluble in a cleaning solvent; and c. a hydrophilic metal substrate, d. the first layer and the substrate not being soluble in the cleaning solvent.

14. A lithographic printing member directly imageable by laser discharge, the member comprising:.

a. an ink-accepting first layer characterized by ablative absorption of imaging radiation;

b. a second layer underlying the first layer, the second layer not being characterized by ablative absorption of imaging radiation and being compatible with but not excessively soluble in a cleaning solvent; and c. a hydrophilic metal substrate, wherein the second layer is polymeric.

15. A lithographic printing member directly imageable by laser discharge, the member comprising:

a. an ink-accepting first layer characterized by ablative absorption of imaging radiation and comprising a nitrocellulose compound;

b. a second layer underlying the first layer, the second layer being compatible with but not excessively soluble in a cleaning solvent; and c. a hydrophilic metal substrate.

16. A lithographic printing member directly imageable by laser discharge, the member comprising:

a. an ink-accepting first layer characterized by ablative absorption of imaging radiation;

b. a second layer underlying the first layer, the second layer being compatible with but not excessively soluble in a cleaning solvent; and c. a hydrophilic metal substrate, wherein the second layer is selected from the group consisting of polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde.

17. A lithographic printing member directly imageable by laser discharge, the member comprising:

a. an ink-accepting first layer characterized by ablative absorption of imaging radiation;

b. a second layer underlying the first layer, the second layer being compatible with but not excessively soluble in a cleaning solvent; and c. a hydrophilic metal substrate, wherein the second layer is selected from the group consisting of polyvinyl pyrrolidone, cellulose ethers, casein, and gelatins.

18. A lithographic printing member directly imageable by laser discharge, the member comprising:

a. an ink-accepting first layer characterized ablative absorption of imaging radiation;

b. a polymeric, hydrophilic second layer underlying the first layer and not being characterized by ablative absorption of imaging radiation; and c. a hydrophilic metal substrate.

19. The member of claim 18 wherein the second layer is present in sufficient thickness to prevent damage to the substrate from exposure to imaging laser radiation.

20. The member of claim 18 wherein the second layer is a primer that anchors the first layer to the substrate.

21. The member of claim 18 wherein the first layer comprises a substance that absorbs near-IR radiation.

22. The member of claim 18 wherein the first layer comprises a substance that absorbs ultraviolet radiation.

23. The member of claim 18 wherein the first layer comprises a substance that absorbs visible radiation.

24. The member of claim 18 wherein the second layer is a crosslinked, polymeric reaction product of polyvinyl alcohol and hydrolyzed tetraethylorthosilicate.

25. A method of imaging a lithographic printing member comprising the steps of:

a. providing a lithographic printing member comprising:

i. an ink-accepting topmost layer characterized by ablative absorption of laser radiation;

ii. a second layer underlying the first layer, the second layer being compatible with but not excessively soluble in a cleaning solvent; and iii. a hydrophilic metal substrate, b. spacing at least one laser source opposite the printing member;

c. guiding the output of the at least one laser source to focus on the printing member;

d. causing relative movement between the at least one laser source and the printing member to effect a scan of the printing member by the laser output; and e. selectively exposing, in a pattern representing an image, the printing member to the laser output during the course of the scan so as to remove at least the top layer, thereby directly producing on the plate an array of image features.

26. The method of claim 25 wherein the second layer of the printing member is hydrophilic.

27. The method of claim 25 further comprising the step of subjecting the printing member to a cleaning solvent to remove portions of the second layer lying within the image features.

28. The method of claim 25 wherein the cleaning solvent is water.

29. The method of claim 28 wherein the water includes a co-solvent.

30. The method of claim 29 wherein the co-solvent is selected from the group consisting of alcohols and glycol ethers.

31. The method of claim 28 wherein the water is pH-buffered to acid or neutral pH.

* * * * *